US005304733A

United States Patent [19]

Hiraide

[11] Patent Number: 5,304,733

[45] Date of Patent: Apr. 19, 1994

[54] MUSIC BOX ROTATING DRUM BODY

[75] Inventor: Shigeaki Hiraide, Nagano, Japan

[73] Assignee: Kabushiki Kaisha Sankyo Seiki Seisakusho, Aichi, Japan

[21] Appl. No.: 977,835

[22] Filed: Nov. 17, 1992

[30] Foreign Application Priority Data

Nov. 19, 1991 [JP] Japan ..... 3-303543

[51] Int. Cl.[5] ..... G10F 01/06

[52] U.S. Cl. ..... 84/96

[58] Field of Search ..... 84/86, 95.1, 95.2, 96, 84/106

[56] References Cited

U.S. PATENT DOCUMENTS

| | | | |
|---|---|---|---|
| 144,084 | 10/1873 | Frankfeld | 84/96 |
| 2,812,680 | 9/1954 | Fedoryszyn | 84/96 |
| 4,144,791 | 3/1979 | Veach | 84/96 |
| 4,616,549 | 10/1986 | Lan | 84/96 |

*Primary Examiner*—Michael L. Gellner
*Assistant Examiner*—P. Stanzione
*Attorney, Agent, or Firm*—Sughrue, Mion, Zinn Macpeak & Seas

[57] ABSTRACT

A music box rotating drum body on which easy-to-read printing is formed without losing the circularity of the drum body, and a method for applying printing to a music box rotating drum body to make it possible to print a large number of characters without losing the circularity are provided. According to the present invention, a music box rotating drum body includes: a rotating drum made by a pipe material planted with a plurality of pins for flicking vibrating valves in accordance with a music program. The rotating drum has a silent area formed on it, where no pins are planted. The silent area has a character portion formed by combinations of character holes.

10 Claims, 7 Drawing Sheets

MUSIC BOX ROTATING DRUM BODY

BACKGROUND OF THE INVENTION

This invention relates to a music box rotating drum body constituted by a metallic pipe material.

In FIG. 1, a bottomed cylinder-shaped box 2, in which a spiral spring serving as a music box driving source and drive gears rotationally driven by the spiral spring are housed, is fixed at a corner portion of a rectangular music box frame 1 with the bottom of the box placed upward. A rotating drum body 3 rotationally driven by the drive gears on the basis of the accumulated force of the spiral spring is supported on the frame 1 by a shaft. Further, a base portion of a diaphragm 7 having a large number of vibrating valves formed in the order of musical scales is fixed on the frame 1. Forward ends of the respective vibrating valves in the diaphragm 7 are arranged opposite to the circumferential surface of the rotating drum body 3. When the rotating drum body 3 is driven to rotate, forward end portions of vibrating valves are flicked by pins (not shown) formed on the circumferential surface of the o rotating drum body 3 to thereby play a predetermined music program.

The rotating drum body 3 comprises a rotating drum 4, and holding members 5 and 6 (constituted by gears or end plates) stuck to opposite ends of the rotating drum 4 so as to be fitted thereto to rotatably hold the rotating drum 4.

A rotating drum body produced by forming holes in a metallic pipe material and driving pins into the holes is one type of music rotating drum body.

A brass pipe material is used as the pipe material in which pins are driven into holes formed by drilling or the like in positions in accordance with the music program.

Further, in the music box rotating drum body, a silent area having no pin is provided between a sound start position and a sound end position.

The silent area is provided because the silent area need be arranged opposite to the vibrating valves when, for example, the rotation of the rotating drum body 3 is stopped to stop the sounding of the music box.

That is, if the rotating drum body 3 is stopped in the condition in which a pin and a vibrating valve for flicking the pin are in contact with each other, the pin and the vibrating valve are loaded on each other so that the pin and the vibrating valve may be deformed thereby causing deterioration of tone quality.

Further, a reference position of the rotating drum body, that is, a reference position indication (reference position mark) for indicating the sound start position of the music box, is formed in a substantially middle position in a direction of rotation, of the silent area.

The reference position indication is provided for indicating the sound start position of the music box and serves as a reference for determining the position relative to holding members (gears or end plates) for rotatably holding the rotating drum body at opposite ends of the rotating drum body.

When, for example, the holding element (such as a hole) for engaging/disengaging a stopper member to stop the sounding of the music box is provided at an end surface of the holding member (gear or end plate), the position of the hole relative to the silent area must be kept constant. This is because the silent area in the rotating drum body must be placed opposite to the vibrating valves when the rotating drum is stopped by the stopper member. Thus, a problem arises in that good sound cannot be produced if a mistake in the holding member mounting position is made when the holding members are combined with the rotating drum.

Further, if the holding element (such as a hole) of the holding member (gear or end plate) and the reference position indication are detected so that the two can be fitted to each other at a predetermined angle in a direction of rotation, automatic assembly of a rotating drum body including gears or end plates can be provided.

Incidentally, it is required that a high-grade music box be beautiful in appearance, because the music box is produced so that not only the rotating drum body is long but the internal structure can be seen from the outside.

Accordingly, though the rotating drum body is rotated to sound the music box, pins are flicked some time after the rotation of the rotating drum body on the basis of the silent area, rather than the pins being flicked soon after the rotation of the rotating drum body.

Also in the case where the sounding of the music box is terminated, the rotation of the rotating drum body is not stopped soon after but the rotation is stopped some time after the rotation of the rotating drum on the basis of the silent area to provide the lingering sound thereof. Thus, the listener's interest (expectation) is roused in between the sense of sight (rotation of the rotating drum) and the sense of hearing (silent area).

The reference position mark formed in a substantially middle position in the direction of rotation, of the silent area is formed by stamping on the basis of plastic working, printing paint, or the like.

Because the subject of the stamping is a cylinder surface in the case of the music box rotating drum body, a problem arises in that good stamping cannot be made, so that the mark may be unreadable. This is because there is a tendency of losing the circularity of the metallic pipe intense pressure is applied, to deform the sectional form of the pipe ellipsoidally. Furthermore, it is difficult to perform stamping of a large number of characters, because a large quantity of deformation of the pipe is exhibited.

Furthermore, in the case of printing using paint, the disadvantage of losing the circularity can be avoided, but a problem arises in that it is necessary to treat the surface of the pipe material with chemicals before printing. Otherwise, a problem arises in the durability of printing.

SUMMARY OF THE INVENTION

Therefore, an object of the present invention is to provide a music box rotating drum body in which printing easy to read is formed without losing the circularity of the drum, and another object of the present invention is to provide a method for applying printing to a music box rotating drum body constituted by a pipe material to make it possible to print a large number of characters without losing its circularity.

To achieve the object described above, according to the first aspect of the present invention, there is provided that a music box rotating drum body comprising a rotating drum made of a pipe material planted with a plurality of pins for flicking vibrating valves in accordance with a music program, said rotating drum having a silent area formed on said rotating drum, said silent area without and pins planted therein, said silent area having a character portion formed by combinations of holes formed in said silent area.

According to another aspect of the present invention, there is provided that a method of producing a music box rotating drum body comprising the steps of: forming pinholes in a music box rotating drum made by a pipe material while calculating pin positions to drive a plurality of pins in said rotating drum in accordance with a music program; driving a forward end of a long wire rod into one of said pinholes; cutting said long wire rod driven into said pinhole so that said long wire rod is projected by a predetermined length from a surface of said rotating drum; and repeating the aforementioned steps while moving said rotating drum both radially and axially under a predetermined condition after said cutting step to thereby plant pins into said rotating drum, wherein said step of forming pinholes includes a step of forming pinholes in a silent area without pin, other than said pinholes to drive said plurality of pins thereinto in accordance with a music program.

BRIEF DESCRIPTION OF THE DRAWINGS

FIG. 3 is a view of the arrangement of all dots showing a pattern of 5×5 dots constituting a character or the like;

DETAILED DESCRIPTION OF THE REFERRED EMBODIMENTS

Figure 1:
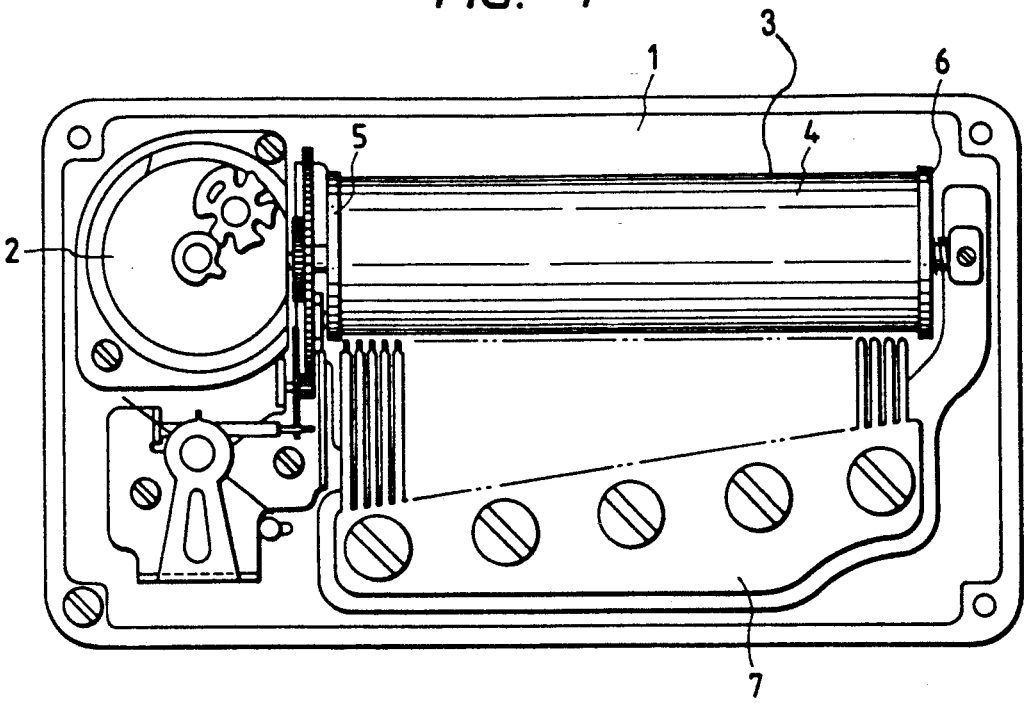
FIG. 1 is a plan view showing the structure of a music box.

The present invention will be described below in detail on the basis of embodiments shown in the drawings.

In the structure of a music box, parts the same as those in FIG. 1 are referenced correspondingly.

Figure 2:
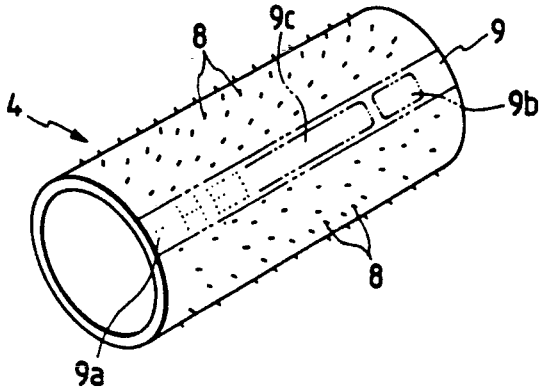
FIG. 2 is a perspective view showing an embodiment of the music box rotating drum.

FIG. 2 shows a music box rotating drum body 3 according to the present invention, which comprises a rotating drum 4, and holding members 5 and 6 (gears or end plates) for rotatably holding the rotating drum 4. The rotating drum 4 is formed from a brass pipe material and has a large number of pins 8 planted on the circumferential surface thereof in an arrangement corresponding to a music program. As described above, it is well known that the music box rotating drum body 3 has a silent area 9 provided between a sound start position and a sound end position.

Further, in the left-hand portion of FIG. 2, in a substantially middle position in an axial direction of the silent area 9 of the rotating drum 4, a reference position indication (reference position indication) 9*a* of the rotating drum body 3 is constituted by using a pinhole formed to plant a pin.

The reference position indication 9*a* serves to indicate the sound start position of the music box and it is used as a reference for determining the position relative to the holding members 5 and 6 fixed to ends of the rotating drum body 3.

When, for example, a hole for engagement/disengagement of a stopper member for stopping the sounding of the music box is provided at either one of the end surfaces of the gears (end plates), it is necessary to keep the position of the silent area 9 relative to the hole constant. This is because the silent area 9 in the rotating drum body 3 must be arranged opposite to a vibrating valve when the rotating drum body 3 is stopped by the stopper. If the hole in either one of the gears (end plates) and the reference position indication 9*a* are detected so that the two can engage each other at a predetermined angle, automatic assembly of the rotating drum body 3 including gears or end plates can be provided.

Further, excluding the reference position indication 9*a*, a string of characters 9*b* indicating the name of the music program for the music box and a message 9*c* may be respectively formed in the silent area 9 of the rotating drum body 3. For example, the message 9*c* can be a message to a person receiving the music box as a gift.

Although the reference position indication 9*a* shown in FIG. 2 is formed independently in the left end of the string of characters for the message 9*c*, it is desirable to use a specific dot in a character in the left end of the string of characters as the reference position indication 9*a* so as to implement the best use of characters formed on the rotating drum body 3 either. For example, in FIG. 3, the dot 9*d* in the third row (downward order) and in the first column (rightward order) or the dot 9*e* in the third row and in the second column, can be determined as a dot for the "reference position indication". When a part of a character, graphic figure, or symbol is also used as the reference position indication of the rotating drum body 3 as described above, the number of characters that can be displayed on the rotating drum body 3 is increased.

Figure 3:
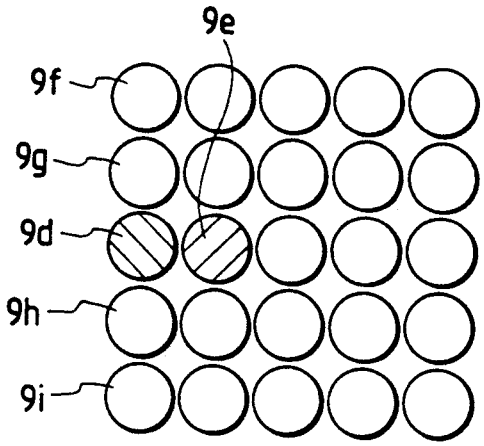
Figure 4:
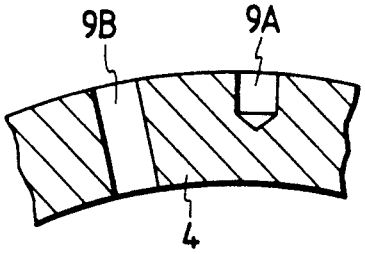
FIG. 4 is a sectional view showing holes formed in the music box rotating drum.
Figure 5:
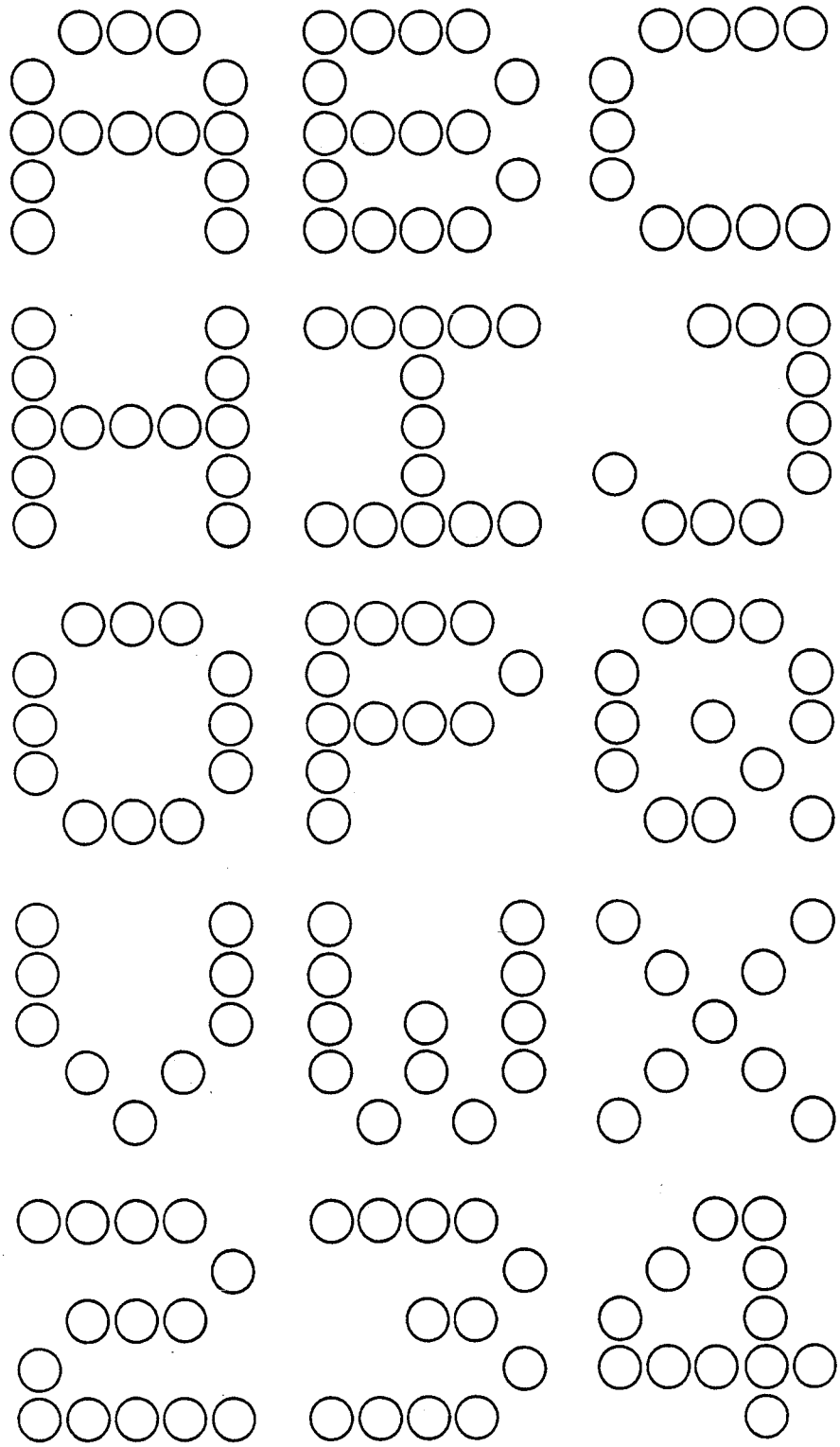
FIG. 5 is a plan view showing an example of characters constituted by dots.
Figure 6:
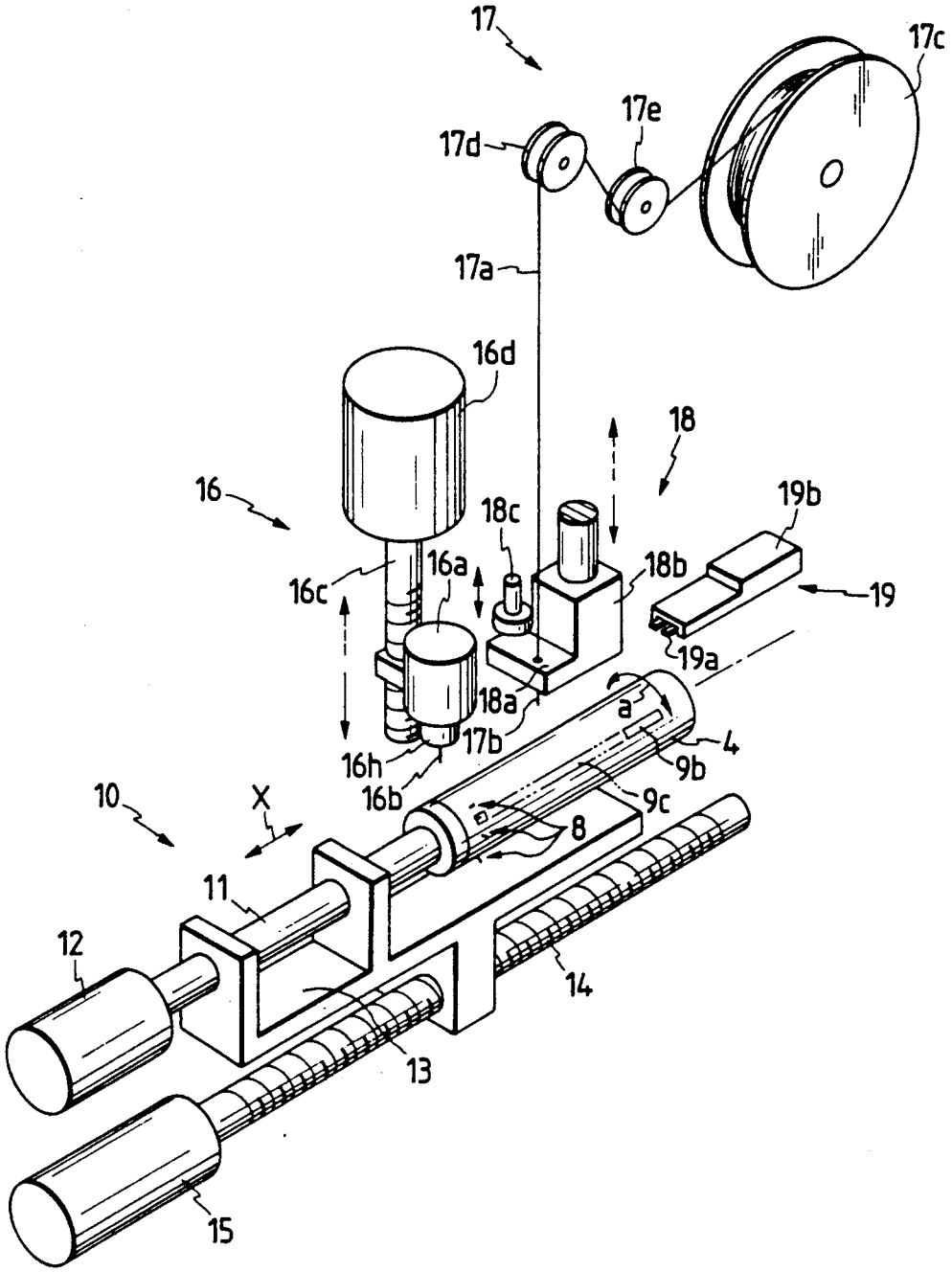
FIG. 6 is a schematic perspective view showing an example of an apparatus suitable for carrying out a method of making printing on a music box rotating drum body.
Figure 7:
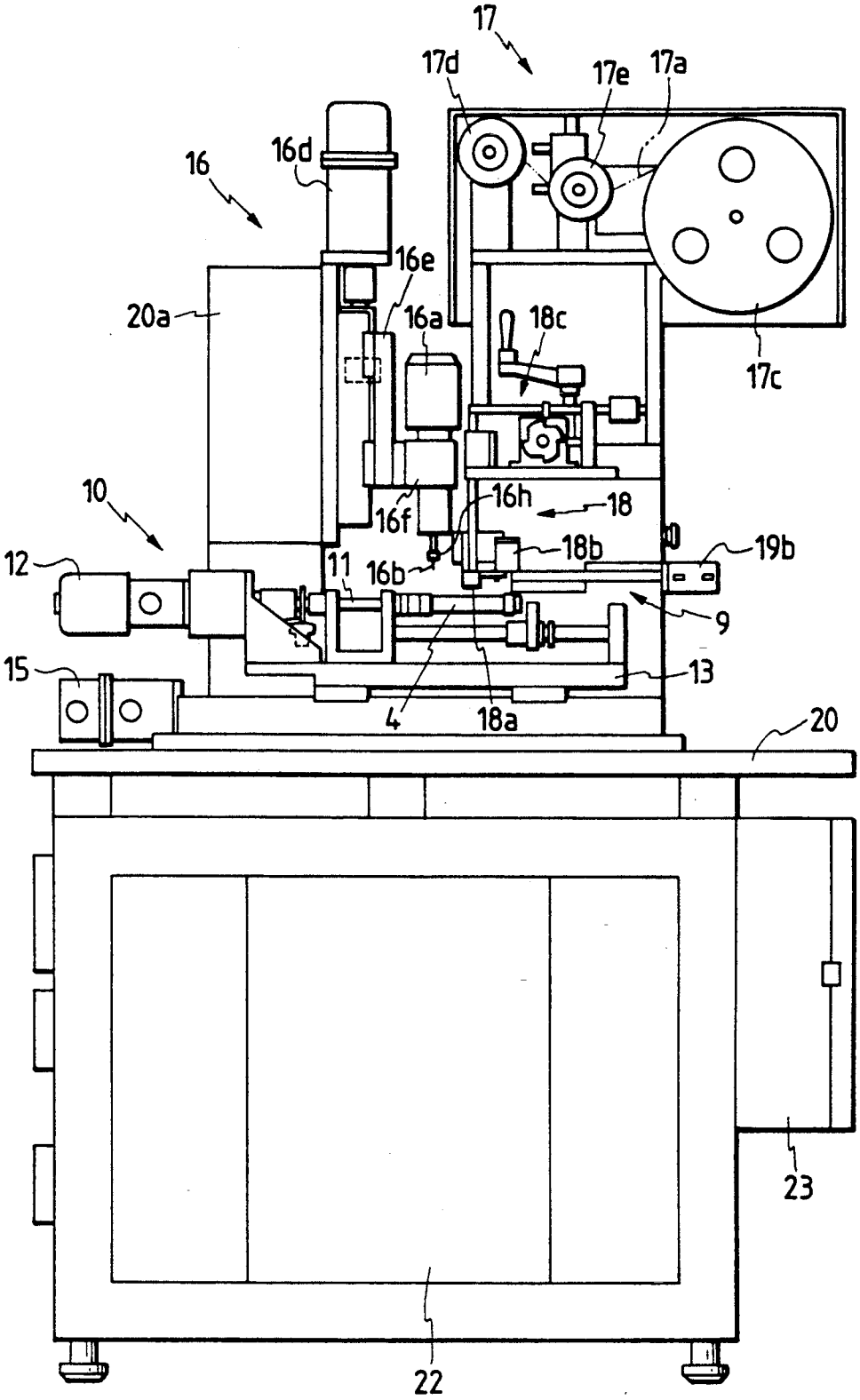
FIG. 7 is a front view of FIG. 6.

The respective indications are formed from characters, symbols and graphic figures each constituted by 5×5 dots as shown in FIGS. 3 and 5 and are constituted by bottomed small-diameter holes 9A as shown in FIG. 4. For example, one character or symbol is constituted by a square of 1.24 mm with the hole 9A diameter of 0.24 mm and the hole pitch of 0.25 mm. In the case of a graphic figure, the width is set to 1.24 mm but the axial length may be formed by using a plurality of characters. A method for forming the holes 9A will be described later.

The hole 9A in each of dots formed in the rotating drum body 3 may be bottomless but, in a type of the music box, the inside of the rotating drum body 3 may be filled with a filler to weight the rotating drum 4 itself to make the tone quality massive. In this case, it is required that the hole has a bottom.

A method for forming holes 9A to constitute a reference position indication 9*a* and a large number of characters formed in the music box rotating drum body 3 shown in FIG. 2 will be described by way of example of an apparatus shown in FIGS. 6 through 9. This apparatus is an apparatus for forming holes to plant a large number of pins 8 in an arrangement corresponding to a music program and then planting the pins 8 into the holes, in which the holes 9A are formed during the hole forming step.

In these drawings, the reference numeral 10 designates a drum supporting unit for supporting the rotating drum 4. The drum supporting unit 10 includes a clamp shaft 11 for rotatably supporting the rotating drum 4, a $\theta$ axis servomotor 12 for rotating the shaft in a radial direction a of the drum, a movable stage 13 for rotatably supporting the clamp shaft 11, and an X axis servomotor 15 for rotating a screw shaft 14 fitted to the movable stage 13 to move the rotating drum 4 in an axial direction x. The screw shaft 14 driven by the X axis servomotor 15 is rotatably supported by a bearing (not shown) provided on a fixed table 20, and moves the movable stage 13 in the axial direction x at a fine pitch. The clamp shaft 11 rotated by the $\theta$ axis servomotor 12 is rotatably supported by the movable stage 13 while the motion thereof in the axial direction is limited by the movable stage 13. The rotating drum 4 is demountably mounted to the clamp shaft 11.

A hole forming unit 16 for forming pinholes 9B in the rotating drum 4 along the axial direction x, a wire rod supply unit 17 for supplying a long wire rod 17*a* to form pins 8 therefrom after cutting, a wire rod driving unit 18 for driving into the pinholes 9B the wire rod 17*a* supplied by the wire rod supply unit 17 and a cutting unit 19 for cutting the wire rod 17*a* driven in the rotating drum 4 are provided above the rotating drum 4. Although a part of the cutting unit 19 is located below the wire rod driving unit 18, relative positions are shifted in FIG. 6.

The hole forming unit 16 is disposed in a hole forming position in the axial direction x and is constituted by a drill 16*b* rotated by a spindle motor 16*a*, and a Z axis servomotor 16*d* for rotating a screw shaft 16*c* to move the drill 16*b* in the vertical direction (z direction). The hole forming unit 16 forms pinholes 9B (see FIG. 4) in rotating drum 4 into which pins 8 are driven. The Z axis servomotor 16*d* is fixed to an upper end of a unit frame 20*a* erected on the fixed table 20, so that a block of a movable table 16*e* is fitted to the screw shaft 16*c* of the motor 16*d*. The spindle motor 16*a* is held by the movable table 16*e* through a bracket 16*f*. The drill 16*b* is connected to a power shaft of the spindle motor 16*a* by a chuck 16*h*. When the Z axis servomotor 16*d* moves down the movable table 16*e*, the drill 16*b* descends while rotating to pierce the rotating drum 4 to thereby form a pinhole 9B.

The hole forming unit 16 is programmed to pierce the rotating drum 4 fully at the time of forming of the pinhole 9B but to descend so as not to pierce the rotating drum 4 fully at the time of forming the hole 9A for each of dots constituting characters 9*a*, 9*b*, and 9*c*.

The wire rod supply unit 17 disposed above the unit frame 20*a* is constituted by a supply reel 17*c* wound with a long wire rod 17*a* formed from a material allowed to form pins 8 therefrom, a fixed pulley 17*d* for leading the wire rod 17*a* to the wire rod driving unit 18, and a movable pulley 17*e* for detecting the tension of the wire rod 17*a*. The supply reel 17*c* is intermittently rotated by a motor not shown, to feed out the wire rod 17*a*. The wire rod 17*a* guided by the fixed pulley 17*d* is pulled down in the vertical direction and has a lower end 17*b* grasped by a chuck 18*a* of the wire rod driving unit 18 which will be described as follows.

Figure 9:
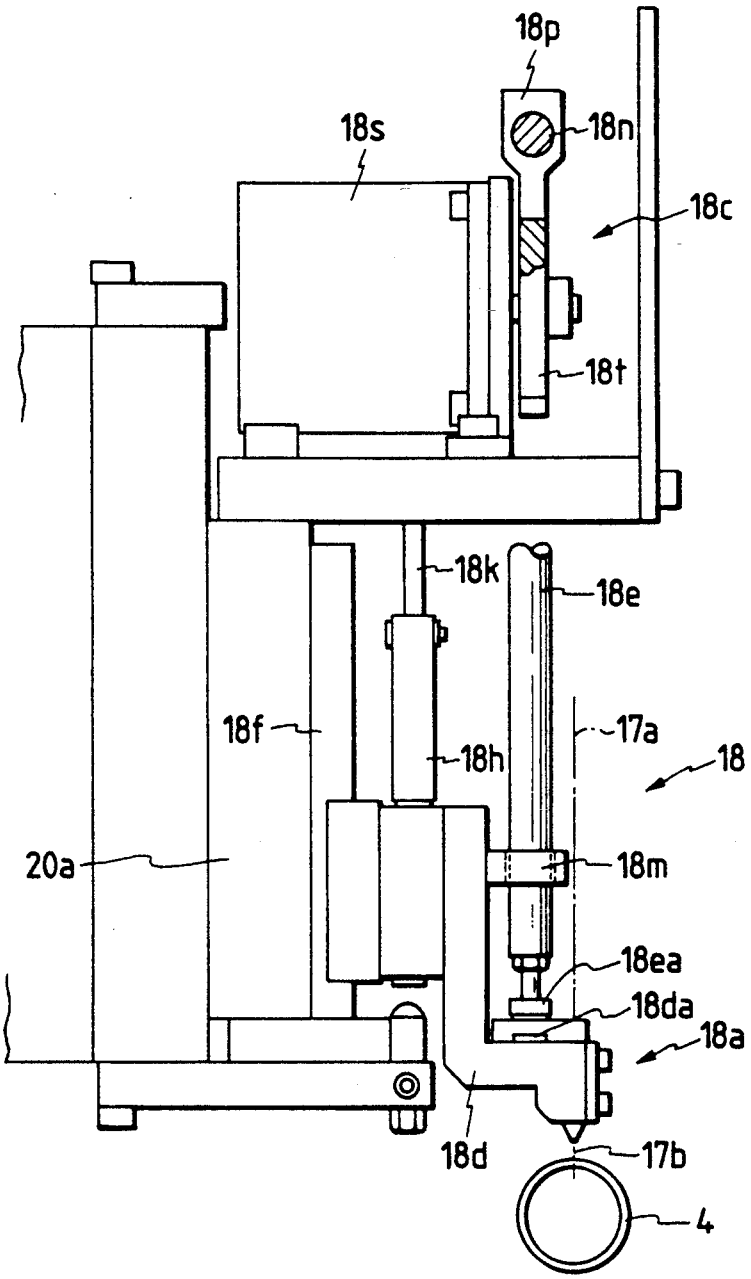
FIG. 9 is an enlarged side view of a main part of FIG. 6.

The wire rod driving unit 18 disposed in the pin driving position, for example, 50 mm far from the hole forming position in the axial direction x, includes a chuck 18*a* for grasping the forward end 17*b* of the wire rod 17*a*, a chuck cylinder 18*b* for opening/shutting the chuck 18*a*, a chuck vertically moving cylinder (in which only a rod 18*k* is shown) for vertically moving the chuck 18*a* in the z direction, and a hammer mechanism 18*c* (partly shown) for hammering a part of the chuck 18*a* to drive the forward end 17*b* of the wire rod 17*a* into the pinhole 9B. As shown in FIG. 9, the chuck 18*a* is supported by a chuck holder 18*d*. The chuck holder 18*d* is provided to the unit frame 20*a* through a guide rail 18*f* so as to be vertically movable. The lower end portion of a rod 18*h* connected to the rod 18*k* of the chuck vertically moving cylinder is connected to the chuck holder 18*d*. When the rod 18*k* descends, the forward end 17*b* of the wire rod 17*a* grasped by the chuck 18*a* is made to face the pinhole 9B. A guide 18*m* is fied to the chuck holder 18*d* so that a hammer shaft 18*e* of the hammer mechanism 18*c* is passed through the guide 18*m* so as to be vertically movable.

A hammer 18*ea* for hammering the upper surfaces 18*da* of the chuck holder 18*d* is fixed to the lower end of the hammer shaft 18*e*. The upper end portion of the hammer shaft 18*e* abuts on a cam 18*t* rotationally driven by a driving motor 18*s* through a lever 18*n* and a cam follower 18*p*. When the cam 18*t* moves down the hammer shaft 18*e*, the upper surface 18*da* of the chuck holder 18*d* is hammered by the hammer 18*ea* at the lower end of the hammer shaft 18*e*.

The cutting unit 19 is constituted by a cutting blade 19*a* for cutting the wire rod 17*a* driven in the rotating drum 4, and a cutting cylinder 19*b* formed of an air cylinder for opening/shutting the cutting blade 19*a*.

Figure 8:
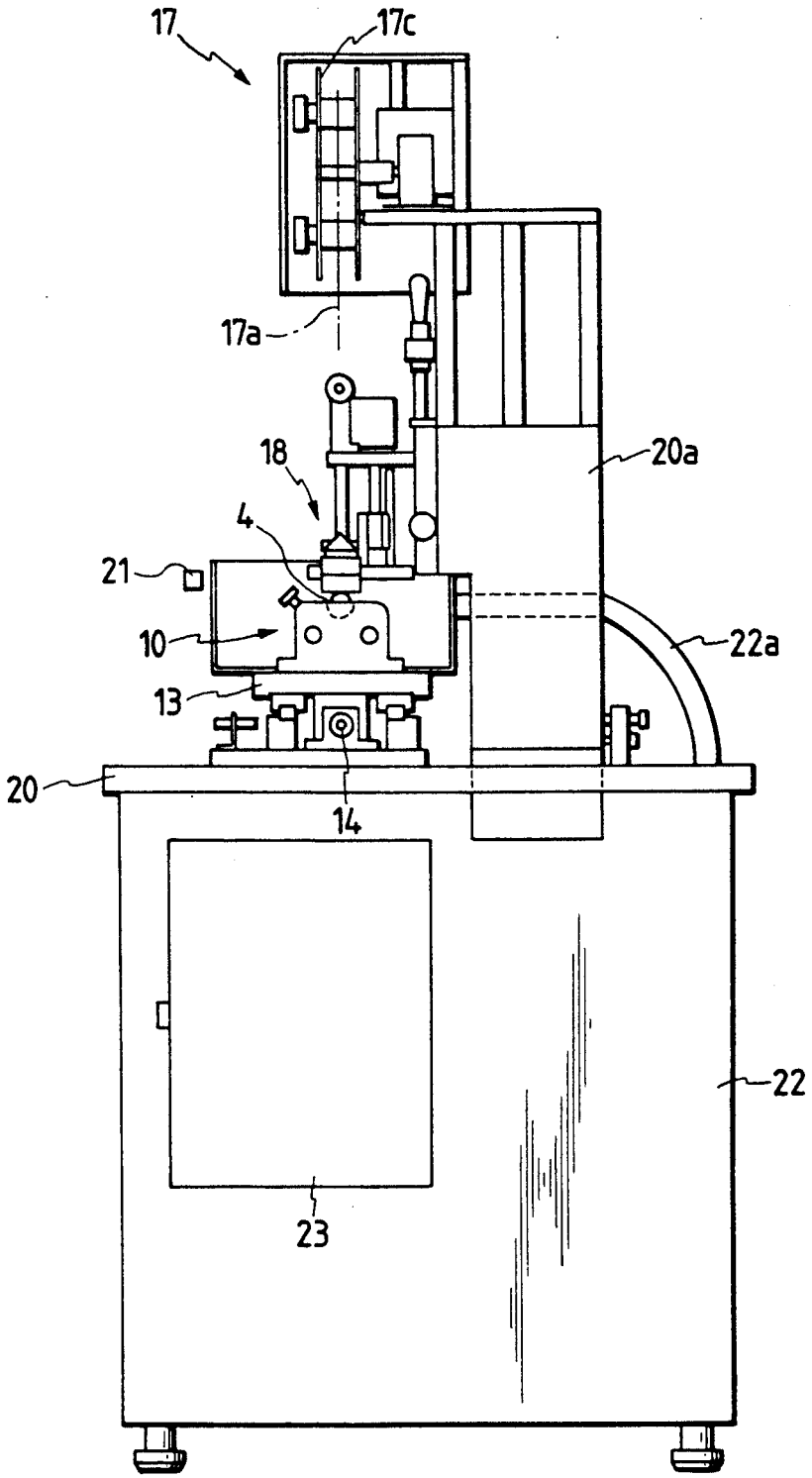
FIG. 8 is a side view of FIG. 6.

The aforementioned respective units are provided on the fixed table 20. As shown in FIG. 8, a drill breaking detection sensor 21 for detecting the breaking of the drill 16*b* is provided to the fixed table 20 so as to be supported by a supporting member not shown. Before the hole forming step, the sensor 21 detects the presence/absence of the drill 16*b*. A dust collection unit 22 is provided below the fixed table 20, so that cutting dust at the time of forming holes is absorbed through a dust collection duct 22*a*.

As will be described later in detail, a control unit 23 for numerically controlling the operations of the motors (or air cylinders) in the respective units is provided. The control unit 23 includes a computer in which data for the radial-direction pitch and axial-direction pitch of pinholes 9B corresponding to the music program of the music box, the diameter and length of the rotating drum body 3, and so on, are programmed preliminarily. Further, data for characters, symbols and graphic figures such as characters 9*a*, 9*b*, and 9*c* each constituted by $5\times5$ dots on the surface of the rotating drum 3 are inputted to the control unit 23.

The operation of the aforementioned apparatus will be described below.

Before the forming of pinholes and dot holes and the driving of a rod wire following the hole forming, the forward end 17*b* of the rod wire 17*a* led out of the wire rod supply unit 17 is grasped by the chuck 18*a* of the wire rod driving unit 18*a*. At this time, the forward end 17*b* of the wire rod is projected down by a suitable length from the chuck 18*a*. The hole forming unit 16 and the wire rod driving unit 18 are respectively placed in ascending positions. The blade 19*a* of the cutting unit 19 is open. The forward end 17*b* of the wire rod 17*a* is placed therebetween. On the other hand, the rotating drum 4 is attached to the clamp shaft 11.

When a hole forming step start signal is outputted from the control unit 23, not only does the X axis servomotor 15 rotationally drive the screw shaft 14 to move the movable stage 13 to thereby calculate the hold forming position in the axial direction x of the rotating drum 4, but the $\theta$ axis servomotor 12 rotates to calculate the hole forming position in the radial direction a of the rotating drum 4, on the basis of a numerical instruction. In this case, the hole forming is not started from the pinholes 9B but started from the first character hole 9A (see the reference numeral 9*f* in FIG. 3). In the case where the pinholes 9B are provided rather to the end portion in the axial direction than the character hole 9A, the hole forming is started from the column of the pinholes 9B.

When the hole forming position 9*f* is calculated, the Z axis servomotor 16*d* rotates the screw shaft 16*c* to move down the drill 16*b*. When the drill 16*b* rotated by the spindle motor 16*a* reaches the rotating drum body 4, a hole 9A is formed therein. At this time, oil is supplied to the cutting position. A rotation control signal for moving down the drill to form a bottomed hole 9A is outputted from the control unit 23 to the Z axis servomotor 16*d*.

After the hole 9A is formed, the hole forming unit 16 is moved up by rotating the Z axis servomotor 16*d* reversely.

When the hole forming with respect to the hole 9*f* is finished, the $\theta$ axis servomotor 13 is driven to rotate the clamp shaft 11 to thereby rotate the rotating drum 4 to the next hole forming position. Assuming that all holes in the left column in FIG. 3 are formed, hole forming is performed in the order of holes 9*g*, 9*d*, 9*h* and 9*i* after the forming of the hole 9*f*.

When the hole forming step for the bottomed holes 9A for the character display portion is finished, the hole forming position in the radial direction a of the rotating drum 4 is calculated by rotating the $\theta$ as servomotor 12 to drive pins 8. When the position of driving of a pin 8 is calculated, the Z axis servomotor 16*d* rotates the screw shaft 16*c* to move down the drill 16*b*. When the drill 16*b* rotated by the spindle motor 16*a* reaches the rotating drum 4, a pinhole 9B as a throughhole, is formed therein. Also at this time, cutting oil is supplied. The hole formed unit 16, descending to the position in which the pinhole 9B is formed as a throughhole, is moved up by rotating the Z axis servomotor 16*d* reversely.

When the step of forming the pinhole 9B is finished, the X axis servomotor 15 operates to rotate the screw shaft to thereby move right by 50 mm the movable stage 13 supporting the rotating drum 4 and place the pinhole 9B under the forward end 17*b* of the wire rod 17*a*. When the rotating drum 4 is moved to the driving position, the chuck cylinder 18*b* operates so that the wire rod 17*a* is strongly chucked by the chuck 18*a*.

When the chuck holder 18*d* is moved down by the operation of the chuck cylinder 18*b*, the forward end 17*b* of the wire rod 17*a* chucked abuts on the pinhole 9B. At this time, the zip holder 18*d* is placed in a freely vertically movable state. When the zip holder 18*d* descends, the rod wire 17*a* is released from the supply reel 17*c*.

When the driving motor 18*s* rotates to rotate the cam 18*t* in the condition in which the forward end 17*b* of the wire rod 17*a* abuts on the pinhole 9B, the lever 18*m* is swung to move up the hammer shaft 18*e*. When the cam follower 18*p* rides over the cam convex portion and then falls in the cam concave portion, the hammer shaft 18*e* descends so that the upper surface 18*da* of the zip holder 18*d* is slightly hammered by the hammer 18*ea*. As a result, the forward end 17*b* of the wire rod is pressed into the pinhole 9B by a predetermined length.

When the driving of the wire rod 17*a* is finished, the chuck cylinder 18*b* operates to once interrupt the wire rod 17*a* grasping operation of the chuck 18*a* and, then, the rod 18*k* of the chuck vertically moving cylinder operates to move up the chuck holder 18*d* by a predetermined length. This predetermined length corresponds to a length obtained by adding a length allowed to operate the cutting blade to a length of projection of the wire rod 17*a* which will be cut while projected by a predetermined quantity from the surface of the rotating drum 4 in the following cutting step. The chuck 18*a* which has ascended by the predetermined length grasps the wire rod 17*a* again.

When the chuck 18*a* grasps the wire rod 17*a*, the cutting cylinder 19*b* of the cutting unit 19 operates to cut the wire rod 17*a* by the cutting blade 19*a*. When the cutting of the wire rod 17*a* is finished, the planting of the rotating drum 4 with a pin 8 is completed.

When the cutting of the wire rod 17*a* is finished, the X axis servomotor 15 rotates the screw shaft 14 to return the movable stage 13 to the next pin driving position in the axial direction (left direction) according to the condition preliminarily programmed in the control unit 23 for the purpose of performing the next hole forming step. Further, the $\theta$ axis servomotor 12 rotates by a predetermined angle to move the rotating drum 4 to the next pin driving position in the radial direction.

Thereafter, the planting of the rotating drum 4 with the next pin 8 is completed by performing the respective steps after the aforementioned hole forming step. When the forming of the holes 9A and pinholes 9B and the driving of the pins 8 in the first cycle are finished, the situation of the procedure goes to the steps in the next cycle. Because the pitch of the character holes 9A ia smaller than the axial-direction pitch of the pins 9B, the next cycle in this case means the hole forming step to be applied only to the character holes 9A.

When the rotating drum 4 is removed from the clamp shaft 11 after the completion of the forming of the all holes 9A and pinholes 9B and the completion of the driving of the pins thereinto, the planting of the rotating drum 4 with a string of characters 9*b* each constituted by $5\times5$ dots, a message 9*c*, a reference position indication 9*a* (in the description, specific holes 9*d* and 9*e* in a character (see FIG. 3)) and pins 8 is completed as shown in FIG. 2.

Although above description has been made upon the case where the step in which the forming of character holes 9A and the forming of pinholes 9B are mixed is provided, the invention can be applied to the case where the steps of forming the two types of holes may be performed separately. That is, character holes 9A are formed first and, after the forming of the holes 9A is finished, the step of forming pinholes 9B and the following steps after the pin driving step may be performed. In this case, both programs for character and pin driving can be provided separately, so that cost in the multikind and small-quantity production of the rotating drum body 3 can be reduced.

Although the drawings show the case where each of characters (and so on) is constituted by $5\times5$ dots, the invention can be applied to the case where each of characters (and so on) may be constituted by $8\times8$ dots.

Although above description has been made upon the case where the drill or the like is used for forming pinholes, the invention can be applied to the case where pinholes are formed by using a laser beam.

In the music box rotating drum body formed from a pipe material according to the first aspect of the invention, characters, graphic figures and so on are comprised of combinations of small-diameter holes. Accordingly, the losing of the circularity of the rotating drum body is avoided, thereby preventing rhythm failure in the sounding. Furthermore, the display of the music program or the like is made clearly, so that it is easy to read. By combining small-diameter holes to form characters, a message can be displayed as the user wishes. The effect of improving the commercial value of the music box is large.

In the method for applying printing to the music box rotating drum body formed from a pipe material according to the second aspect of the invention, characters, graphic figures and so on are printed by combinations of small-diameter holes. Accordingly, the characters and so on are prevented from separating from the pipe material and disappearing, so that not only the losing of the circularity of the pipe material can be avoided but a long string of characters or the like can be formed as well.

What is claimed is:

1. A music box rotating drum body comprising:

a rotating drum made by a pipe material planted with a plurality of pins for flicking vibrating valves in accordance with a music program, said rotating drum having formed therein a silent area in which no pins are planted therein, said silent area having a character portion in which characters are formed by combinations of character holes formed therein, wherein said character holes have a different depth than that of pinholes provided for the planting of said pins.

2. A music box rotating drum body as claimed in claim 1, wherein said character holes and said pinholes are formed by drilling.

3. A music box rotating drum body as claimed in claim 2, wherein said character holes have substantially the same diameter as that of said pinholes.

4. A music box rotating drum body comprising:

a rotating drum including a pipe material planted with a plurality of pins for flicking vibrating valves in accordance with a music program and a silent area in which no pins are planted therein; and holding means for respectively rotatably holding opposite ends of said rotating drums;

wherein said silent area has a reference position indicated by holes formed therein for indicating a reference position to be used in assembling said rotating drum and said holding members, wherein characters or graphic figures are printed in said silent area by combinations of character holes formed in said silent area, said character holes having a different depth than that of pinholes provided for the planting of said pins.

5. A music box rotating drum body as claimed in claim 4, wherein said character holes and said pinholes are formed by drilling.

6. A music box rotating drum body as claimed in claim 5, wherein said character holes have substantially the same diameter as that of said pinholes.

7. A method of producing a music box rotating drum body comprising the steps of:

forming pinholes in a music box rotating drum made by a pipe material while calculating pin positions to drive a plurality of pins in said rotating drum in accordance with a music program said drum having a silent area in which pinholes are not formed;

driving a forward end of a long wire rod into one of said pinholes;

cutting said long wire rod driven into said pinhole so that said wire rod is projected by a predetermined length from a surface of said rotating drum;

repeating the aforementioned steps while moving said rotating drum both radially and axially under a predetermined condition after said cutting step to thereby plant pins into said rotating drum; and character holes in said silent area where no pins are planted, said character holes being arranged to form characters or graphic figures in said silent area.

8. A method of producing a music box rotating drum body as claimed in claim 7, wherein holes are formed by drilling said music box rotating drum.

9. A method of producing a music box rotating drum body as claimed in claim 7, further comprising the steps of:

inputting hole information into a control unit;

sending a hole forming start signal form said signal unit to servomotors that control the position of said drum body; and positioning said drum body via said servomotors based upon said signal, so that said character holes and said pinholes may be properly formed.

10. A method of producing a music box rotating drum body as claimed in claim 7, wherein said character holes have a different depth than that of said pinholes.

* * * * *